US010559917B2

(12) United States Patent
Wang

(10) Patent No.: US 10,559,917 B2
(45) Date of Patent: Feb. 11, 2020

(54) MAGNETIC ELECTRICAL CONNECTOR ASSEMBLY

(71) Applicant: FOXCONN INTERCONNECT TECHNOLOGY LIMITED, Grand Cayman (KY)

(72) Inventor: Qiang Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/892,372

(22) Filed: Feb. 8, 2018

(65) Prior Publication Data

US 2018/0233852 A1 Aug. 16, 2018

(30) Foreign Application Priority Data

Feb. 16, 2017 (CN) ..... 2017 1 0083510
Feb. 16, 2017 (CN) ..... 2017 2 0141514 U

(51) Int. Cl.
*H01R 13/62* (2006.01)
*H01R 13/52* (2006.01)
*H01R 13/74* (2006.01)

(52) U.S. Cl.
CPC ..... *H01R 13/6205* (2013.01); *H01R 13/521* (2013.01); *H01R 13/5202* (2013.01); *H01R 13/745* (2013.01)

(58) Field of Classification Search
CPC ..... H01R 13/5202; H01R 13/521; H01R 13/6205; H01R 13/745
See application file for complete search history.

(56) References Cited

U.S. PATENT DOCUMENTS 3,621,448 A * 11/1971 Arnold ..... H01R 13/5219 439/272
4,960,391 A * 10/1990 Beinhaur ..... H01B 17/305 174/152 GM
6,083,025 A * 7/2000 Anbo ..... H01R 13/629 439/296
6,659,796 B1 * 12/2003 Waddell ..... H01R 13/745 439/352
7,497,693 B1 * 3/2009 Wu ..... H01R 13/2442 439/39
7,815,474 B1 * 10/2010 Lin ..... H01R 13/2421 439/482
9,419,377 B2 * 8/2016 Zhu ..... H01R 13/24
9,806,458 B1 * 10/2017 Chiu ..... H01R 13/6205
2006/0172609 A1 8/2006 Wang et al.
(Continued)

FOREIGN PATENT DOCUMENTS

CN 206004013 U 3/2017
CN 206271987 U 6/2017
TW M454008 5/2013

*Primary Examiner* — Oscar C Jimenez
(74) *Attorney, Agent, or Firm* — Wei Te Chung; Ming Chieh Chang

(57) ABSTRACT

An electrical connector assembly includes a panel mount connector having an electrical connector having an insulative housing, a plurality of contacts and magnetic elements retained in the insulative housing, and a panel mounting piece which the insulative housing is attached to and has latching devices for attaching to an electrical device. A complementary connector is adapted to be mated with the panel mount connector.

20 Claims, 12 Drawing Sheets

(56) References Cited

U.S. PATENT DOCUMENTS

| | | | | |
|---|---|---|---|---|
| 2009/0117783 | A1* | 5/2009 | Wu | H01R 13/2435<br>439/660 |
| 2010/0099279 | A1* | 4/2010 | Homme | H01R 13/5202<br>439/78 |
| 2012/0115356 | A1* | 5/2012 | Tashiro | H01R 13/5202<br>439/538 |
| 2014/0256163 | A1* | 9/2014 | Kuo | H01R 13/6205<br>439/39 |
| 2014/0322929 | A1* | 10/2014 | Asai | H01R 13/6205<br>439/39 |
| 2015/0188253 | A1* | 7/2015 | Tada | H01R 13/6205<br>439/39 |
| 2016/0218462 | A1* | 7/2016 | Zhao | H01R 13/6205 |
| 2017/0093087 | A1* | 3/2017 | Esmaeili | H01R 12/61 |
| 2017/0110827 | A1* | 4/2017 | Finona | H01R 11/30 |
| 2018/0351284 | A1* | 12/2018 | Miyazawa | H01R 13/5202 |

* cited by examiner

MAGNETIC ELECTRICAL CONNECTOR ASSEMBLY

BACKGROUND OF THE INVENTION

1. Field of the Invention

The invention is related to an electrical connector assembly, and particular to a magnetic electrical connector assembly.

2. Description of Related Arts

Most of time, the electrical connector is mounted upon the printed circuit board. Anyhow, sometimes, the electrical connector is required to be assembled to an electrical device in compliance with the contour thereof.

It is desired to have the corresponding electrical connector equipped with a panel mounting piece adapted to be easily and compliantly attached to the corresponding electrical device without jeopardizing the smooth configuration of the contour of the electrical device.

SUMMARY OF THE INVENTION

An electrical connector assembly includes a panel mount connector having an electrical connector having an insulative housing, a plurality of contacts and magnetic elements retained in the insulative housing, and a panel mounting piece which the insulative housing is attached to and has latching devices for attaching to an electrical device. A complementary connector is adapted to be mated with the panel mount connector.

DETAILED DESCRIPTION OF THE PREFERRED EMBODIMENT

Reference will now be made in detail to the preferred embodiment of the present invention.

Figure 1:
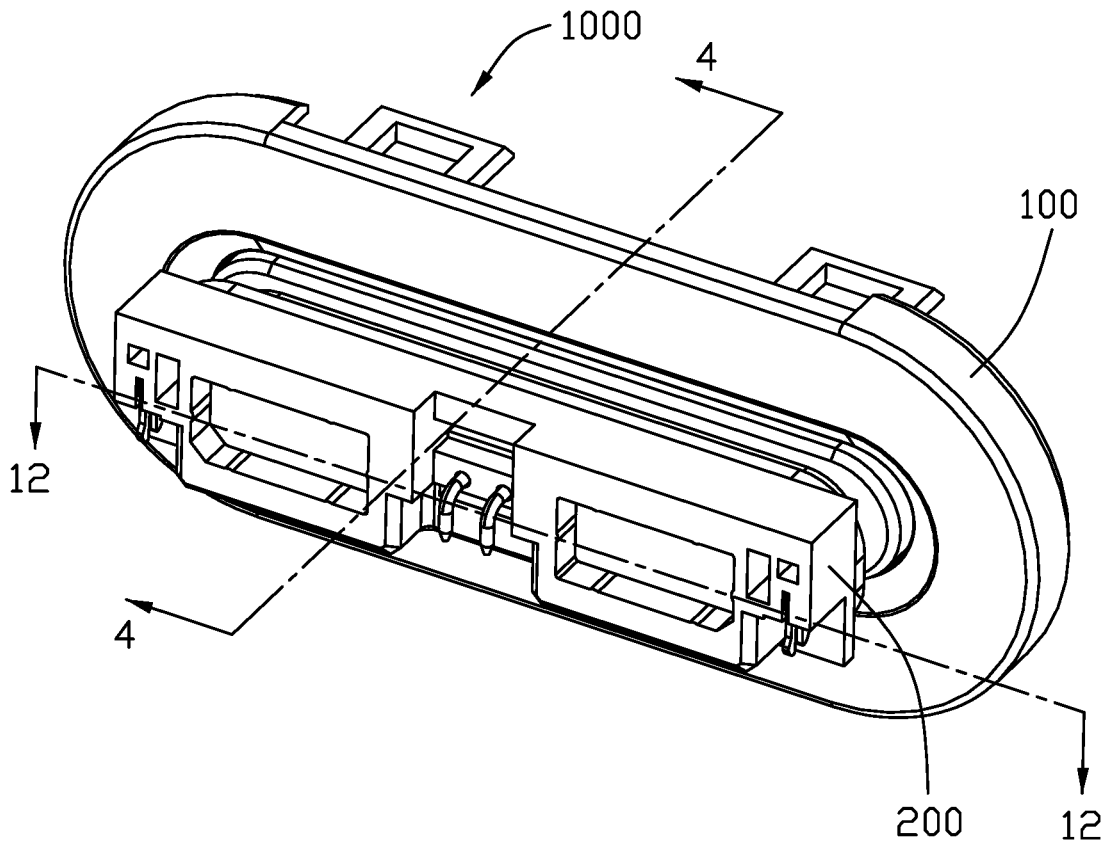
FIG. 1 is a front assembled perspective view of a preferred embodiment of an electrical connector assembly according to the invention and showing a first connector and a second connector mated with each other.
Figure 2:
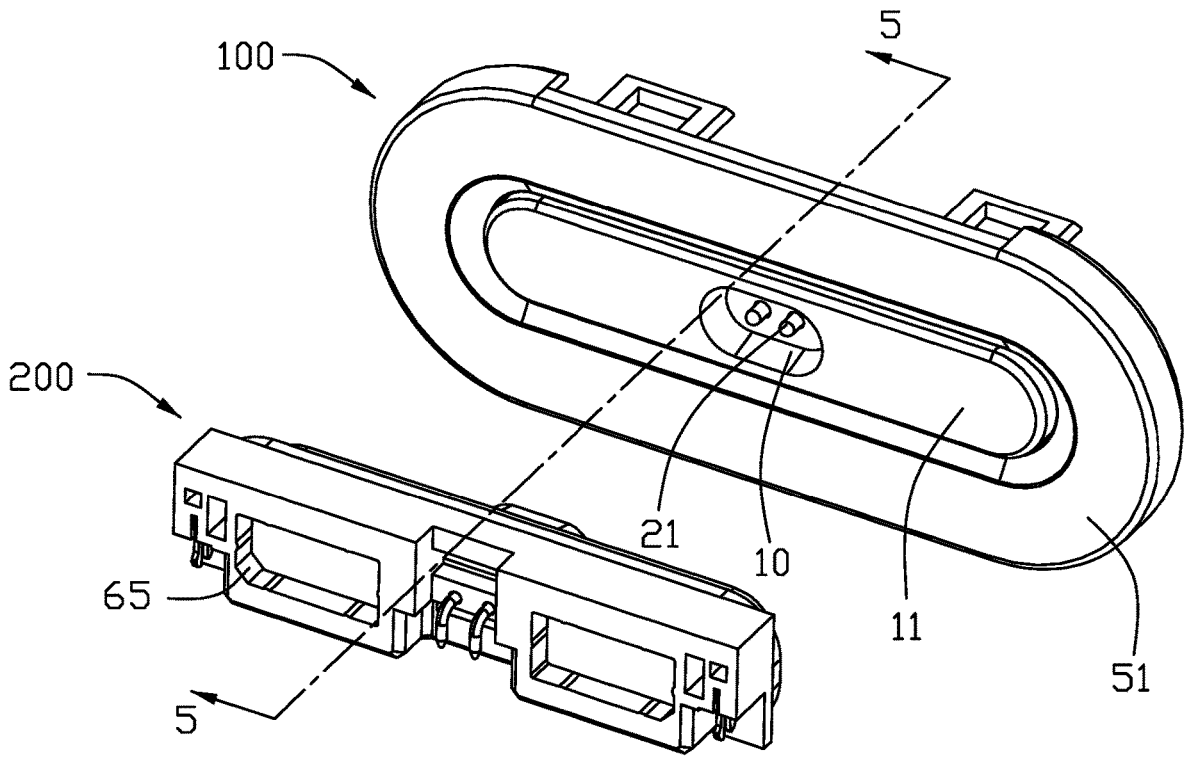
FIG. 2 is a perspective view of the electrical connector assembly of FIG. 1, showing the first and second connectors are separated from each other.
Figure 3:
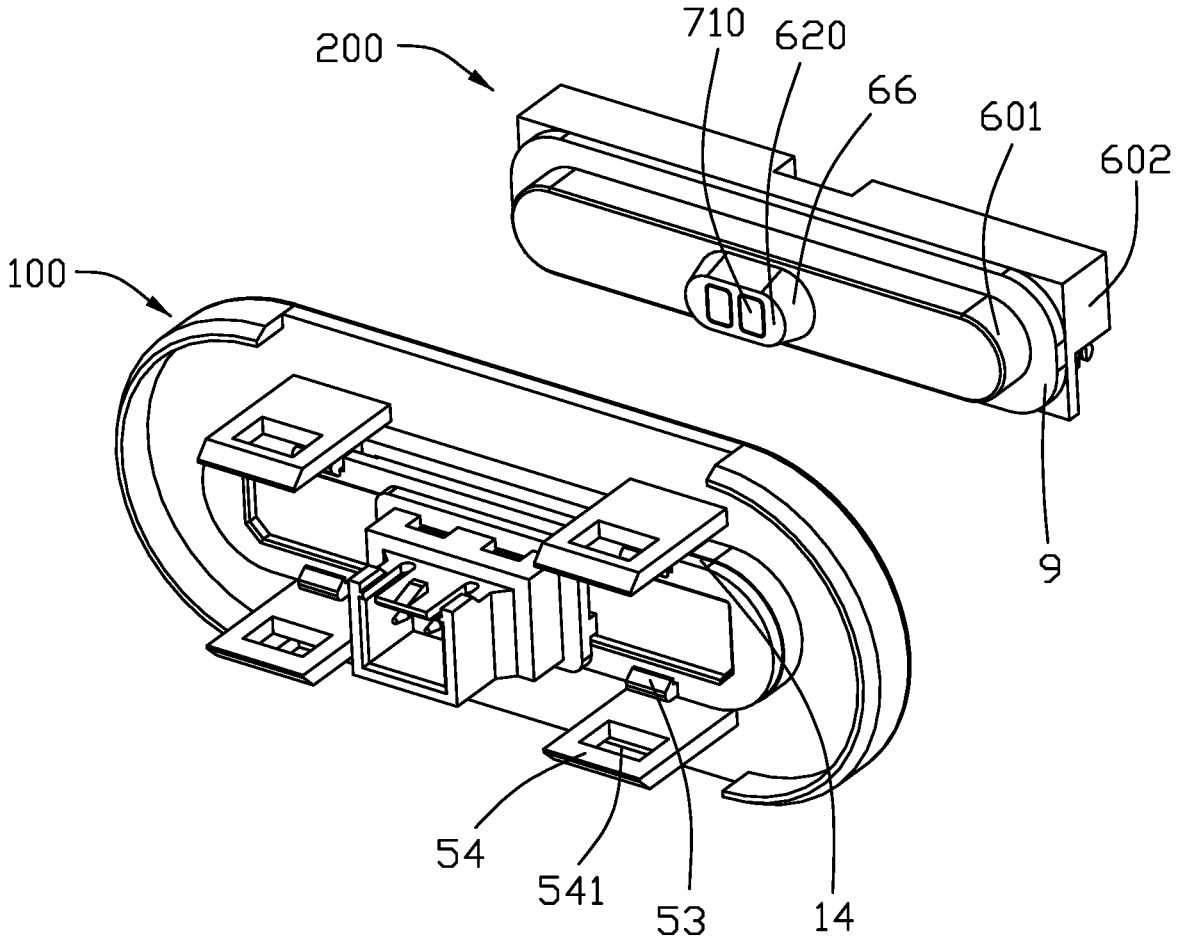
FIG. 3 is another view of the electrical connector assembly of FIG. 2.
Figure 4:
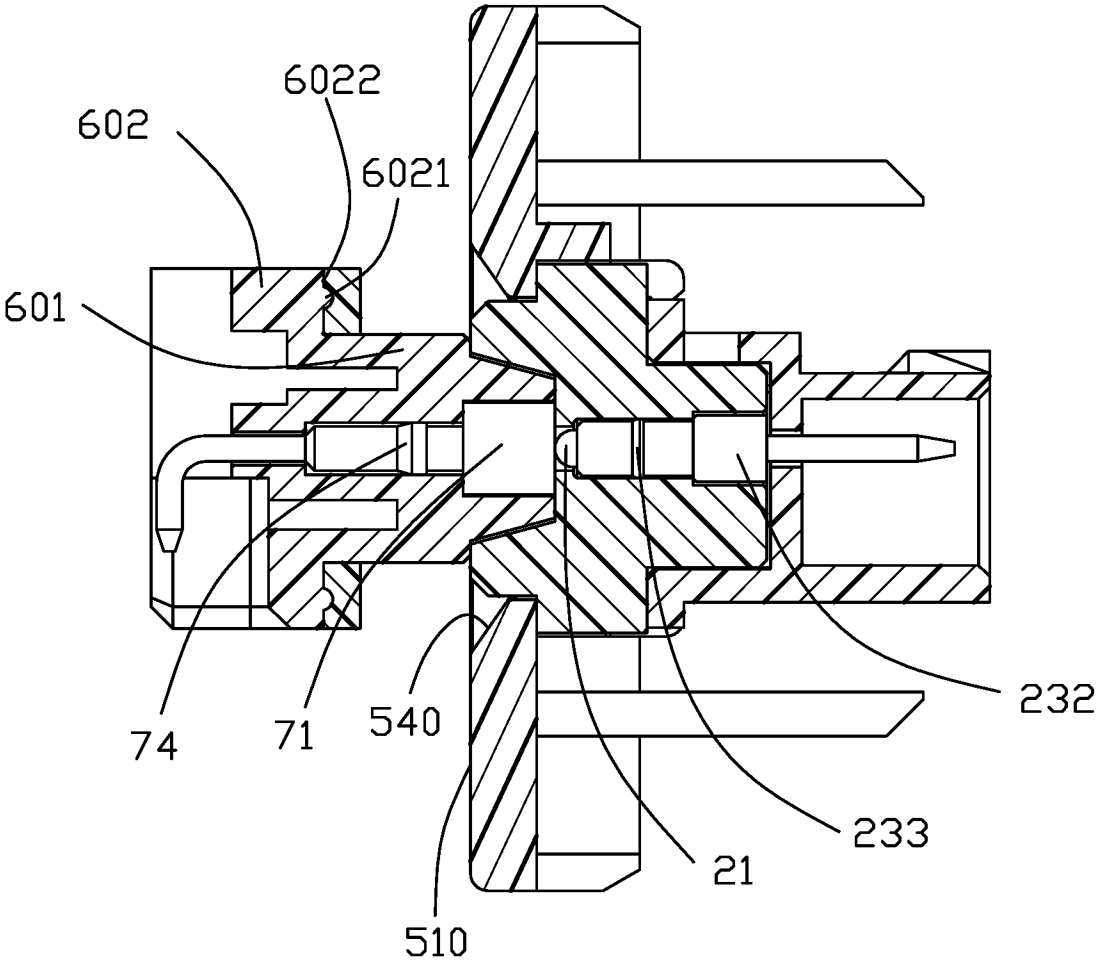
FIG. 4 is a cross-sectional view of the electrical connector assembly of FIG. 1.
Figure 5:
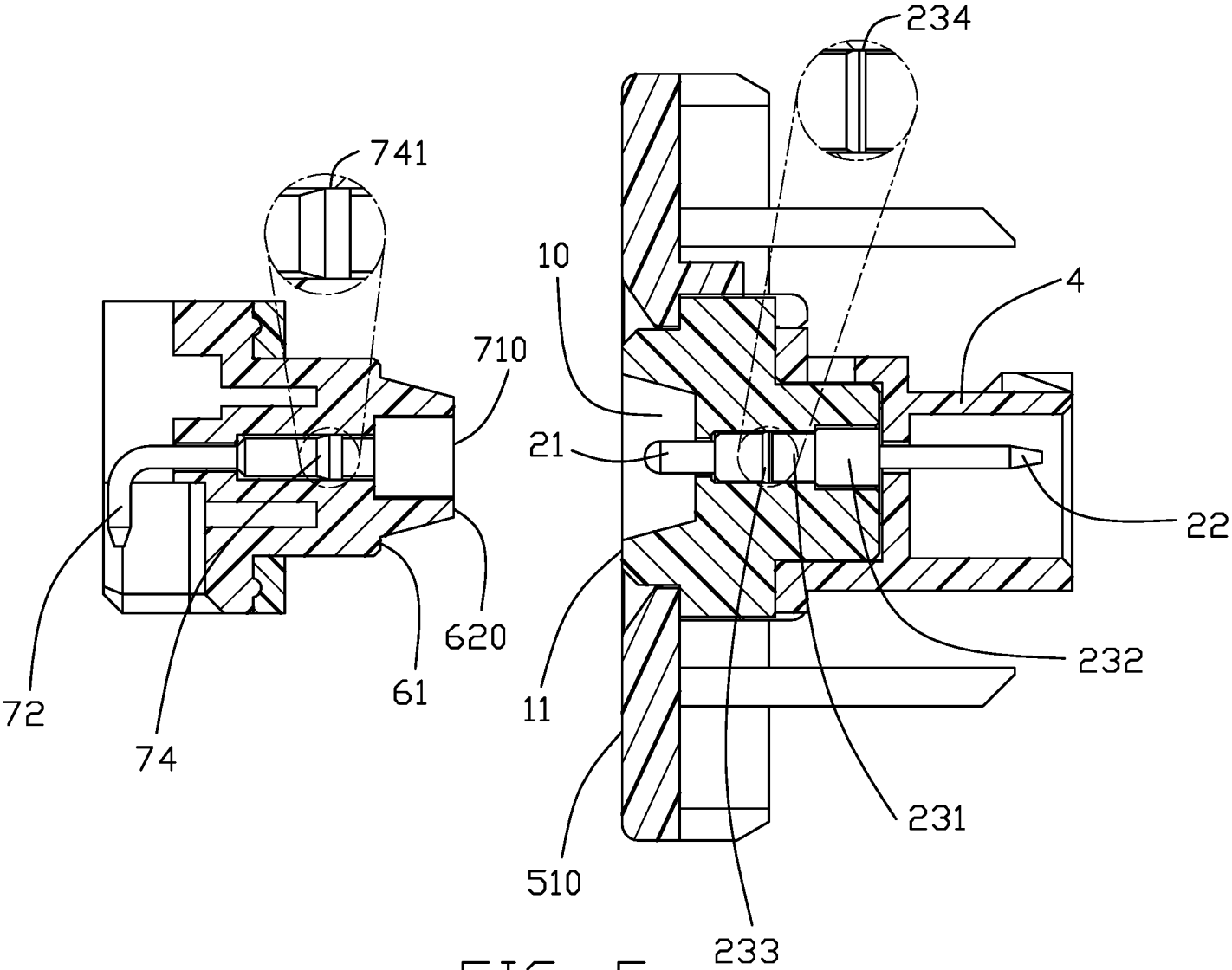
FIG. 5 is a cross-sectional view of the electrical connector assembly of FIG. 2.
Figure 6:
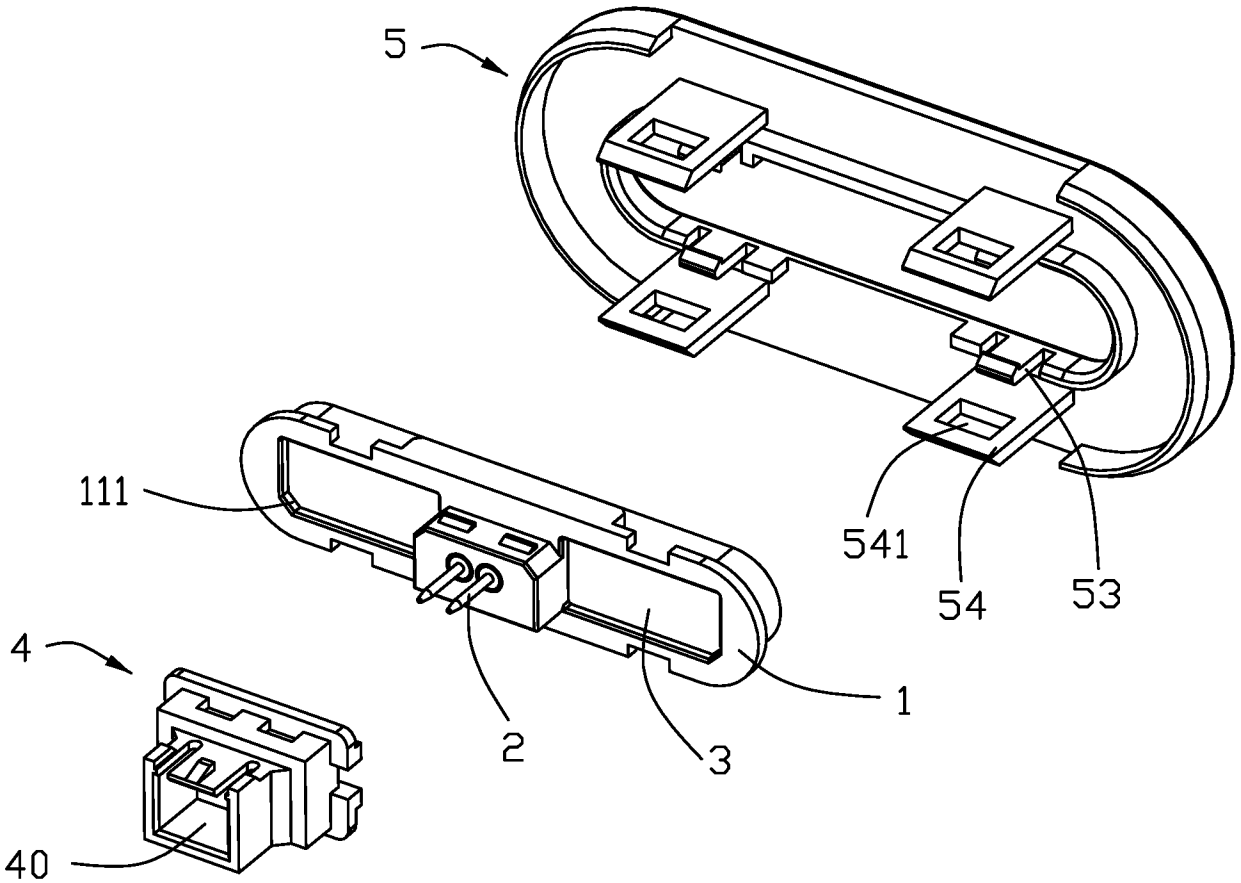
FIG. 6 is an exploded perspective view of the first connector of the electrical connector assembly of FIG. 1.
Figure 7:
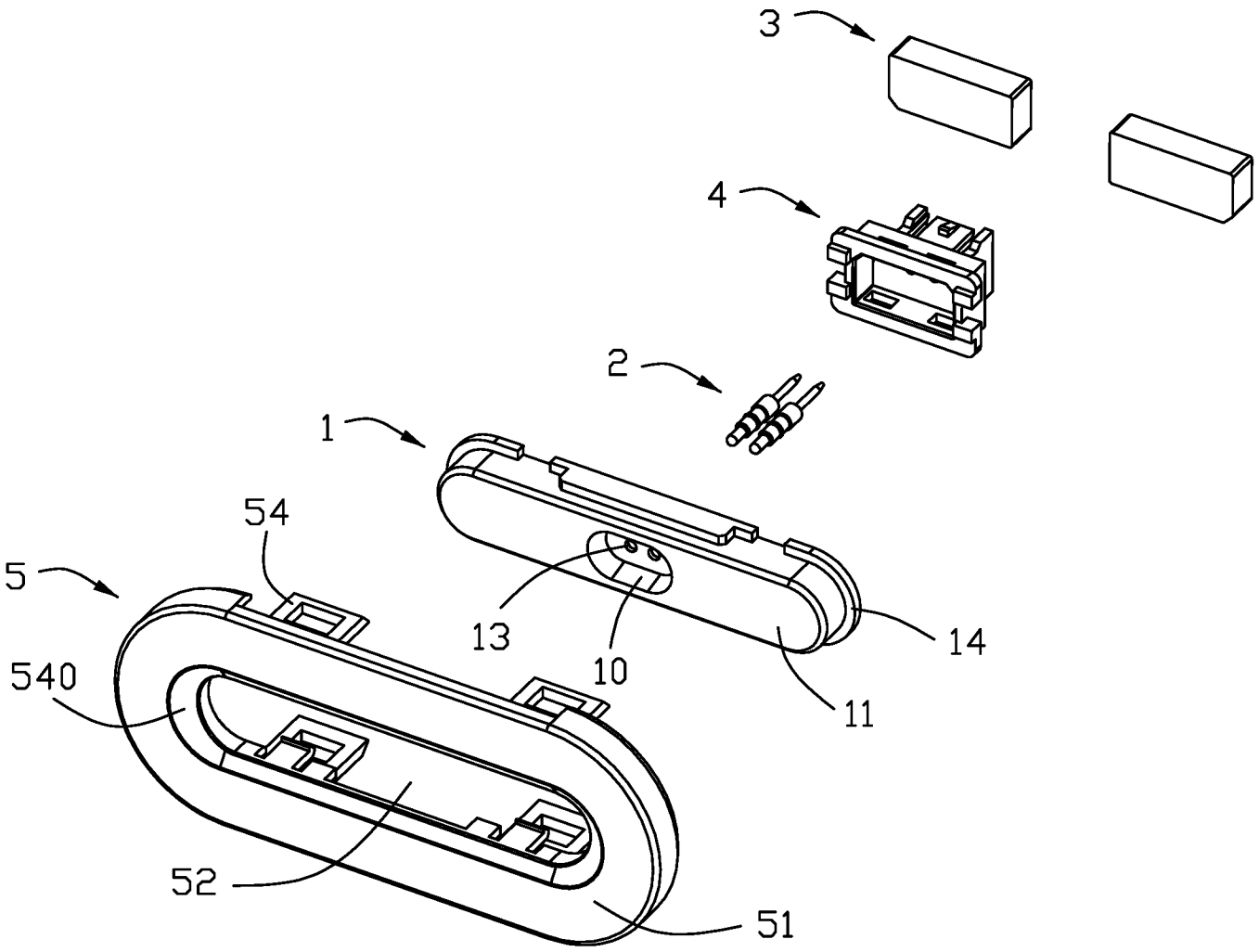
FIG. 7 is a further exploded perspective view of the first connector of the electrical connector assembly of FIG. 6 wherein the magnets and the contacts are removed from the housing.
Figure 8:
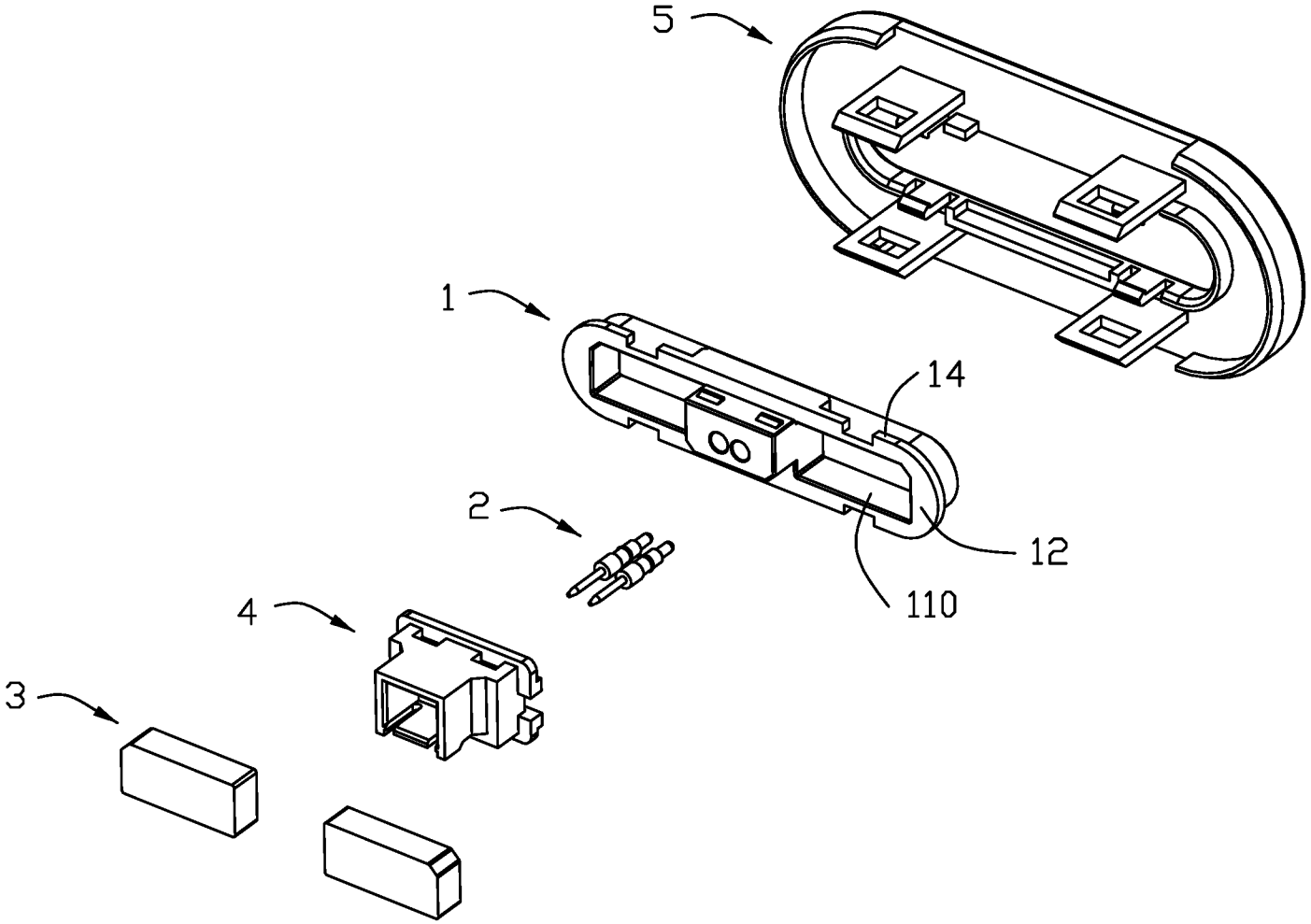
FIG. 8 is another exploded perspective view of the first connector of the electrical connector assembly of FIG. 7.
Figure 9:
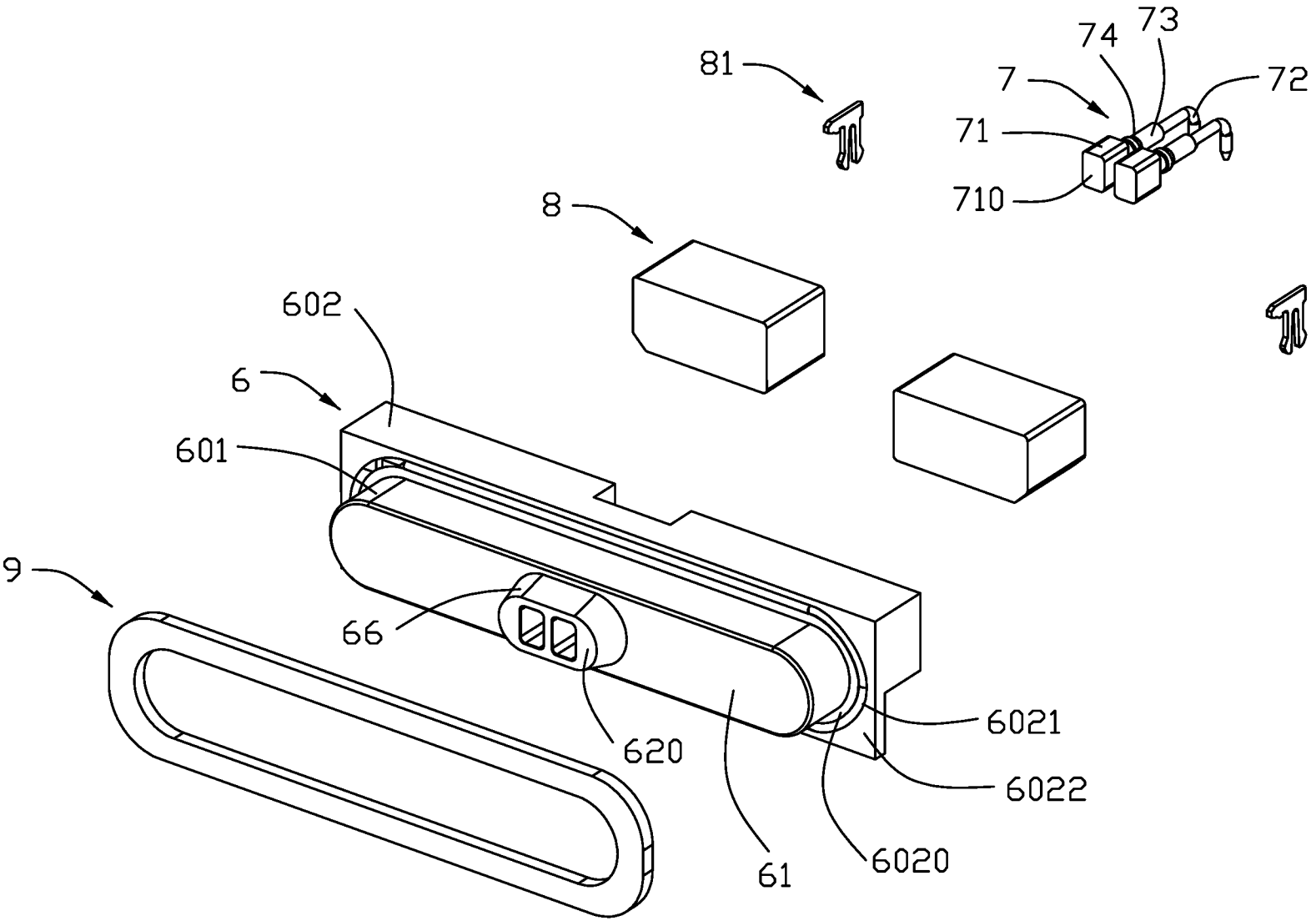
FIG. 9 is an exploded perspective view of the second connector of the electrical connector assembly of FIG. 1.
Figure 10:
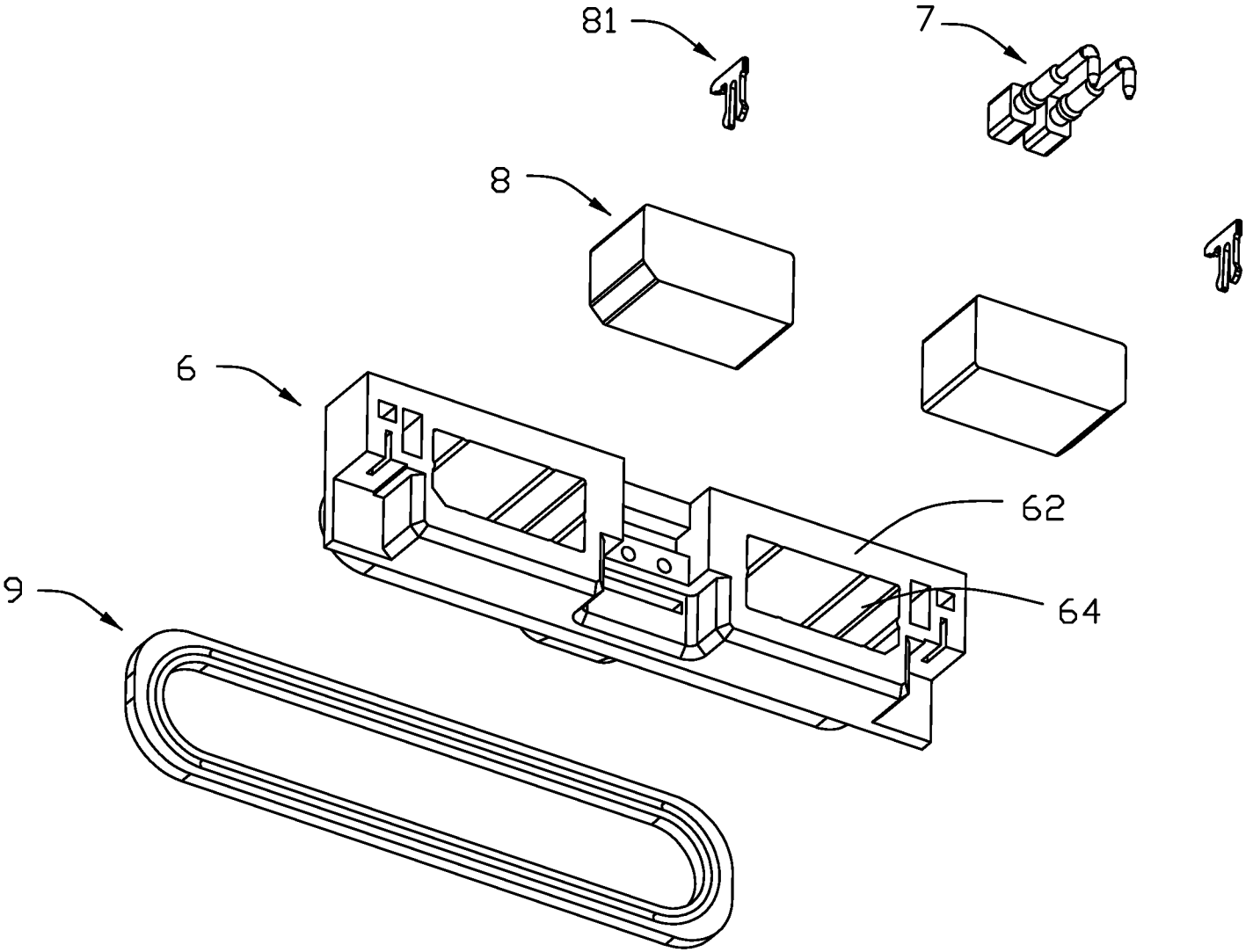
FIG. 10 is another exploded perspective view of the second connector of the electrical connector assembly of FIG. 9.
Figure 11:
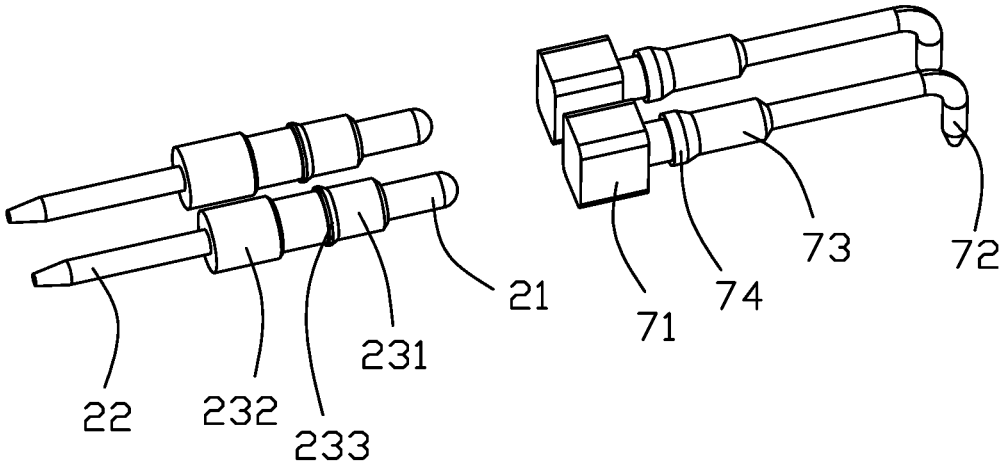
FIG. 11 is a perspective view of the first contacts of the first connector and the second contacts of the second connector.
Figure 12:
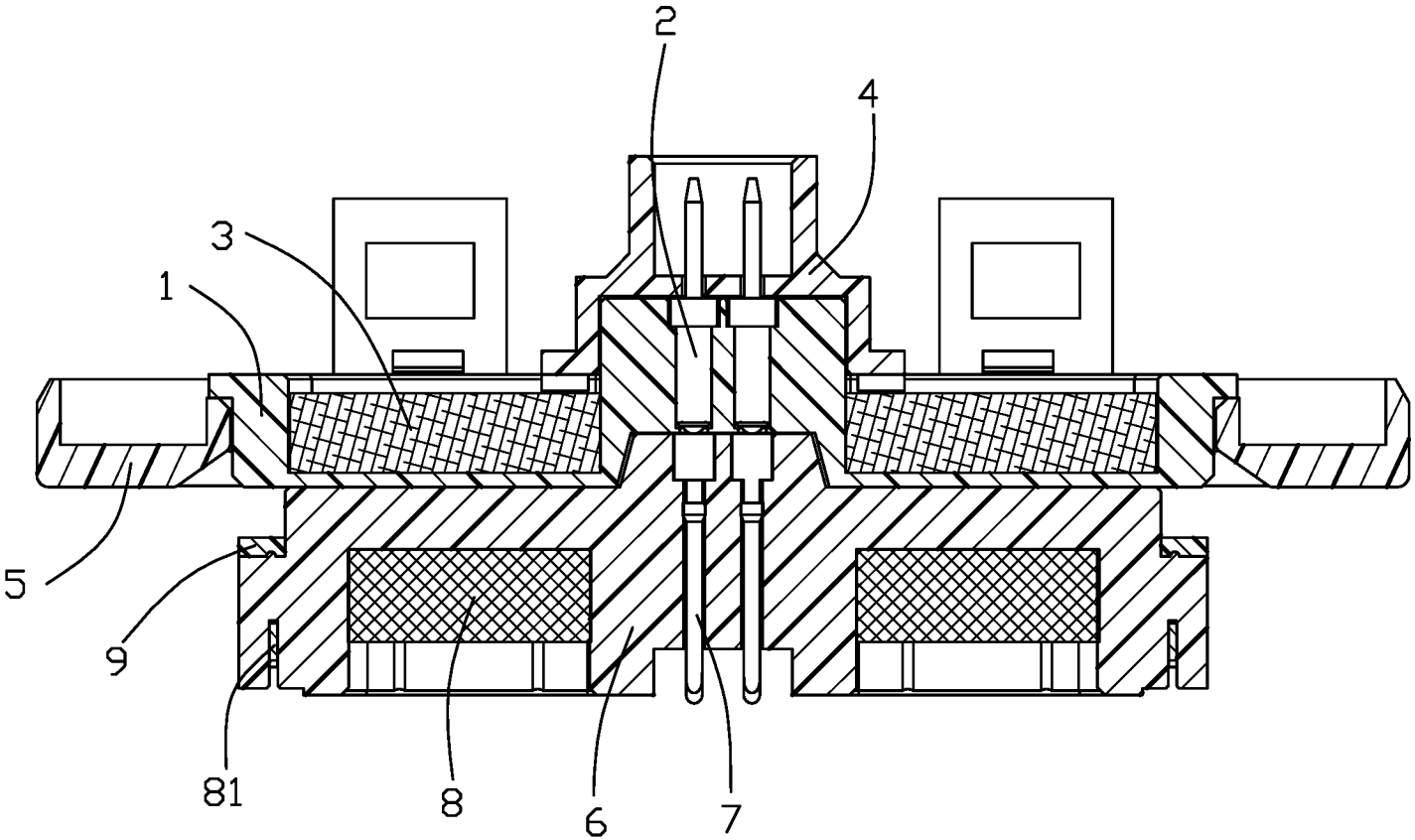
FIG. 12 is another cross-sectional view of the electrical connector assembly of FIG. 1.

Referring to FIG. 1 to FIG. 5, an electrical connector assembly 1000 includes a first connector 100 and a second connector 200 mated with the first connector 1 for power transfer. Generally, the first connector 100 is installed upon the refrigerator and the second connector 200 is attached the accessory associated with the refrigerator.

The first connector 100 includes a first insulative housing 1, a plurality of first contacts 2, a pair of first magnetic elements 3, a securing piece 4 secured with a cable set (not shown), and a panel mounting piece 5 for attachment to an electrical device, e.g., the refrigerator.

The first insulative housing 1 includes a first mating face 11, a first mounting face 12 opposite to the first mating face 11, and a pair of sides linking the opposite first mating face 11 and first mounting face 12. A mating cavity 10 is formed in the first mating face 11, and a pair of first passageways 13 extend through the insulative housing 1 and forwardly communicate with the mating cavity 10.

The first contact 2 is received within the corresponding first passageway 13 with a so-called pogo pin. The first contact 2 includes a first contacting section 21 extending into the mating cavity 10, a first mounting section 22 extending beyond the first mounting face 12, and a first middle section linked between the first contacting section 21 and the first mounting section 22. The middle section 23 includes a first segment 231 and the second segment 232. The first contacting section 21 is moveable within the first segment 231. The first segment 231 includes an annular barb 233 with an exterior surface 234. Through the cooperation of the second segment 232 and the annular barb 233, the first contact 2 is securely retained in the corresponding first passageway 13.

The first insulative housing 1 further includes a pair of receiving cavities 110 to receive the corresponding magnetic elements 3. The receiving cavity 110 is equipped with a chamfer 111 for orientation.

The securing piece 4 is secured to the housing 1 either integrally or discretely, and includes a space 40 in which the first mounting section 22 extends for connecting to a corresponding wire (not shown).

The panel mounting piece 5 is secured to the housing 1 either integrally or discretely and includes a panel section 51 surrounding the first housing 1 and a receiving space 52 in the panel section 51 with the corresponding annular chamfered face 540 for receiving the housing 1. A plurality of first latches 53 are formed around the receiving space 52 for locking the housing 1. The panel section 51 forms a front face 510 coplanar with the mating face 11. The panel mounting piece 5 further includes a plurality of second latches 54 with corresponding latching holes 541 for locking to the external device (not shown). The second latches 54 are located outside of the first latches 53 with regard to the receiving space 52.

The second connector 200 includes a second insulative housing 6, a plurality of second contacts 7 and the second magnetic elements 8 secured within the second insulative housing 6, a waterproof gasket 9 and a pair of board mounting piece 81.

The second insulative housing 6 includes a second mating face 61, a second mounting face 62 opposite to the second mating face 61, and a pair of sides linked between the opposite second mating face 61 and second mounting face 62. During mating, the first mating face 11 and the second mating face 61 abut against each other.

The second insulative housing 6 includes a mating section 66 extending forwardly beyond the second mating face 61 which has a coupling face 620. The second insulative housing 6 includes a front base 601 and a rear base 602 wherein the mating section 66 extends from the second mating face 61.

The second contact 7 includes a solid head 71, the second mounting section 72 and a second middle section 73 linked between the solid head 71 and the second mounting section 72. The head 71 is exposed upon the coupling face 620 and has a mating surface 710 coplanar with the coupling face 620. During mating, the mating section 66 is inserted into the mating cavity 10, and the first contacting section 21 abuts resiliently against the head 71. The head 71 is larger than the second middle section 73. The second middle section 73 forms a second annular barb 74. The second housing 6 forms a plurality of second passageways 63. Through the cooperation of the head 71 and the second annular barb 74, the second contact 7 is securely retained in the corresponding second passageway 63. Notably, the rectangular configuration of the head 71 prevents self-rotation of the second contact 7.

The rear base 602 forms a restriction protrusion 6021 with a restriction groove 6020 from the front base 601. A step 6022 is formed between the front base 601 and the rear base 602, and the restriction protrusion 6021 extends from the step 6022 forwardly, and the waterproof gasket 9 surrounds the restriction groove 6020 in a restrictive manner. The gasket 9 has an annular groove to receive the restriction protrusion 6021.

The second insulative housing 6 forms a pair of second receiving cavities 64 to receive the corresponding second magnetic elements 8. The receiving cavity 64 is equipped with a chamfer 65 for orientation.

Notably, during mating, the mating section 66 is snugly received within the mating cavity 10, the first mating face 11 abuts against the second mating face 61 while the front base 601 is exposed to an exterior transversely wherein the first magnetic elements 3 and the second magnetic elements 8 do not directly contact each other but protectively hidden behind the corresponding first mating face 11 and second mating face 61.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector including a first insulative housing defining a forward first mating face, a plurality of first contacts disposed in the first housing, a first magnetic element protectively hidden in the first insulative housing, a mating cavity formed behind the first mating face in which the first contacts are retractably disposed; and a second connector adapted to be mated with the first connector and including a second insulative housing defining a forward second mating face, a plurality of second contacts disposed in the second housing, a second magnetic element protectively hidden in the second housing, a mating section forwardly protruding beyond the second mating face; wherein said first connector further includes a panel mounting piece having a first latch to lock to the first insulative housing, and a second latch for locking to an exterior device; wherein said first latch is located in front of the second latch along a mating direction.

2. The electrical connector assembly as claimed in claim 1, wherein the second housing includes a rear base and a front base extending forwardly from the rear base, the mating section extending forwardly from the front base, the second mating face defined on the front base, during mating, the front base being exposed to an exterior transversely.

3. The electrical connector assembly as claimed in claim 2, wherein a waterproof gasket is attached upon a front face of the rear base to surround the front base, and said gasket is spaced from the first insulative housing in a mating direction.

4. The electrical connector assembly as claimed in claim 1, wherein said first connector further includes a securing piece attached behind the first housing to define a space in which the first contacts extend rearwardly.

5. The electrical connector assembly as claimed in claim 1, wherein the first insulative housing is configured to be assembled to the panel mounting piece forwardly along a mating direction.

6. The electrical connector assembly as claimed in claim 5, wherein the panel mounting piece includes a panel section with a receiving space therein, and said housing is retained in the receiving space.

7. The electrical connector assembly as claimed in claim 1, wherein said second contact forms a rectangular head for avoiding self-rotation.

8. The electrical connector assembly as claimed in claim 1, wherein the mating cavity and the mating section are tapered for guiding during mating.

9. The electrical connector assembly as claimed in claim 1, wherein the panel mounting piece forms a front face coplanar with first mating face.

10. The electrical connector assembly as claimed in claim 1, wherein the panel mounting piece further includes a panel section from which the second latch rearwardly extends.

11. The electrical connector assembly as claimed in claim 10, wherein said panel section defines a receiving space therein, and the second latch is located outside of the first latch with regard to the receiving space.

12. An electrical connector for attachment to an external device, comprising:

an insulative housing defining a forward mating face, a plurality of contacts disposed in the housing, a magnetic element protectively hidden in the insulative housing, a mating cavity formed behind the mating face in which the contacts are retractably disposed; and a panel mounting piece having a first latch to lock the insulative housing, and a second latch for locking to an exterior device; wherein the panel mounting piece includes a panel section with a receiving space therein to receive the insulative housing, and the second latch is located outside of the first latch with regard to the receiving space.

13. The electrical connector as claimed in claim 12, wherein the first latch is located in front of the second latch along a mating direction.

14. The electrical connector as claimed in claim 12, wherein the first insulative housing is configured to be assembled to the panel mounting piece forwardly along a mating direction.

15. The electrical connector as claimed in claim 14, wherein the panel mounting piece includes a panel section with a receiving space therein, and said housing is retained in the receiving space.

16. The electrical connector as claimed in claim 15, wherein the mating cavity is tapered, and the receiving space is chamfered.

17. The electrical connector as claimed in claim 12, wherein the panel mounting piece forms a front face coplanar with a first mating face.

18. The electrical connector as claimed in claim 12, wherein the second latch extends rearwardly from the panel section.

19. An electrical connector comprising:

an insulative housing including a rear base and a front base forwardly extending from the rear base, a mating section forwardly extending from the front base with a tapered contour, a passageway formed in the housing;

a contact disposed in the passageway and defining a front solid head with a rectangular configuration in the mating section in a flush manner and a mounting section behind the solid head having an annular barb cooperated with the passageway; and a waterproof gasket attached upon a front face of the rear base to surround the front base.

20. The electrical connector as claimed in claim 19, wherein the rear base forms an annular restriction protrusion on a front face and the waterproof gasket forms an annular groove to receive said annular restriction protrusion.

* * * * *